US010172499B2

(12) United States Patent
Beckerman et al.

(10) Patent No.: US 10,172,499 B2
(45) Date of Patent: Jan. 8, 2019

(54) DISPENSER

(71) Applicant: COLGATE-PALMOLIVE COMPANY, New York, NY (US)

(72) Inventors: Scott Beckerman, South Orange, NJ (US); Andrew Lanza, West New York, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 15/351,839

(22) Filed: Nov. 15, 2016

(65) Prior Publication Data

US 2018/0132672 A1 May 17, 2018

(51) Int. Cl.

| | |
|---|---|
| ***A47K 5/12*** | (2006.01) |
| ***A47K 5/122*** | (2006.01) |
| ***A47K 5/18*** | (2006.01) |
| ***B65D 1/32*** | (2006.01) |
| ***B65D 35/08*** | (2006.01) |
| ***B65D 47/06*** | (2006.01) |
| ***B01F 5/06*** | (2006.01) |
| ***B01F 7/00*** | (2006.01) |
| ***B01F 13/00*** | (2006.01) |
| ***B01F 15/00*** | (2006.01) |
| ***B01F 15/02*** | (2006.01) |
| ***B65D 35/24*** | (2006.01) |

(52) U.S. Cl.

CPC ..... *A47K 5/1212* (2013.01); *A47K 5/122* (2013.01); *A47K 5/18* (2013.01); *B01F 5/0614* (2013.01); *B01F 5/0647* (2013.01); *B01F 7/00391* (2013.01); *B01F 13/0022* (2013.01); *B01F 15/00506* (2013.01); *B01F 15/0256* (2013.01); *B65D 1/32* (2013.01); *B65D 35/08* (2013.01); *B65D 35/24* (2013.01); *B65D 47/06* (2013.01)

(58) Field of Classification Search

CPC ..... A47K 5/1212; B01F 7/00
USPC ..... 222/207, 145.6
See application file for complete search history.

(56) References Cited

U.S. PATENT DOCUMENTS

| | | | | |
|---|---|---|---|---|
| 1,446,639 A | | 2/1923 | Cleve | |
| 3,920,226 A | | 11/1975 | Walt | |
| 3,947,200 A | * | 3/1976 | Fischer | B29C 47/046 425/131.1 |
| 3,950,122 A | * | 4/1976 | Fischer | B29C 47/38 415/116 |
| 4,100,618 A | * | 7/1978 | Fischer | B01F 7/082 366/297 |

(Continued)

FOREIGN PATENT DOCUMENTS

WO 2010/008789 1/2010

OTHER PUBLICATIONS

International Search Report and Written Opinion of the International Searching Authority in International Application No. PCT/US2017/061570, dated Apr. 30, 2018.

*Primary Examiner* — Jeremy Carroll

(57) ABSTRACT

A dispenser includes a body defining an internal volume and an opening that provides a path of fluid communication between the internal volume and an exterior of the body. A first tubular member extends through the opening. A length of the first tubular member is greater than or equal to about 150% of a height of the body. In response to squeezing the body, a composition in the internal volume flows out of the body through the opening and into the first tubular member.

6 Claims, 4 Drawing Sheets

(56) References Cited

U.S. PATENT DOCUMENTS

| | | | | |
|---|---|---|---|---|
| 4,201,528 | A * | 5/1980 | Fischer | B29C 47/362 366/81 |
| 4,359,283 | A | 11/1982 | McClellan | |
| 4,407,647 | A * | 10/1983 | Denzler | C11D 13/18 366/77 |
| 4,575,272 | A | 3/1986 | Borrow | |
| 4,893,940 | A | 1/1990 | Waisberg | |
| 5,913,632 | A | 6/1999 | Persad | |
| 6,394,314 | B1 * | 5/2002 | Sawhney | B05C 17/00506 222/137 |
| 8,100,295 | B2 * | 1/2012 | Keller | B05C 17/00506 222/137 |
| 8,746,509 | B2 * | 6/2014 | An | A61C 9/0026 222/145.6 |
| 8,940,361 | B2 | 1/2015 | Smith et al. | |
| 2012/0104034 | A1 * | 5/2012 | Koenigsknecht | G07F 11/44 221/277 |
| 2013/0183426 | A1 * | 7/2013 | Ledger | A47J 43/042 426/519 |

* cited by examiner

DISPENSER

BACKGROUND

Compositions are typically stored in a dispenser. For example, toothpaste may be stored in a tube that is squeezed to eject the toothpaste therefrom. In another example, a shampoo may be stored in a bottle, and the shampoo may be poured out of the bottle. The composition may have a tendency to separate into portions of higher and lower densities in conventional dispensers. In addition, conventional dispensers do not appeal to children, and thus, provide no incentive for the children to use the composition. What is needed is an improved dispenser.

BRIEF SUMMARY

A dispenser includes a body defining an internal volume and an opening that provides a path of fluid communication between the internal volume and an exterior of the body. A first tubular member extends through the opening. A length of the first tubular member is greater than or equal to about 150% of a height of the body. In response to squeezing the body, a composition in the internal volume flows out of the body through the opening and into the first tubular member.

In another embodiment, the dispenser includes a body defining an internal volume and an opening that provides a path of fluid communication between the internal volume and an exterior of the body. An auger is positioned within the internal volume. A composition is also positioned within the internal volume.

A method for dispensing a composition from a dispenser is also disclosed. The method includes coupling a first tubular member to a body of the dispenser. The body defines an internal volume having the composition therein, and the first tubular member extends less than or equal to 1 cm into the internal volume. The method also includes squeezing the body to cause at least a portion of the composition to flow out of the body and into the first tubular member.

In another embodiment, the method includes rotating an auger positioned within a body of the dispenser, and opening a lid that is coupled to the body. The lid covers an opening in the body when the lid is in a closed position, and the composition is able to flow out of the body through the opening when the lid is in an open position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawing, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1:
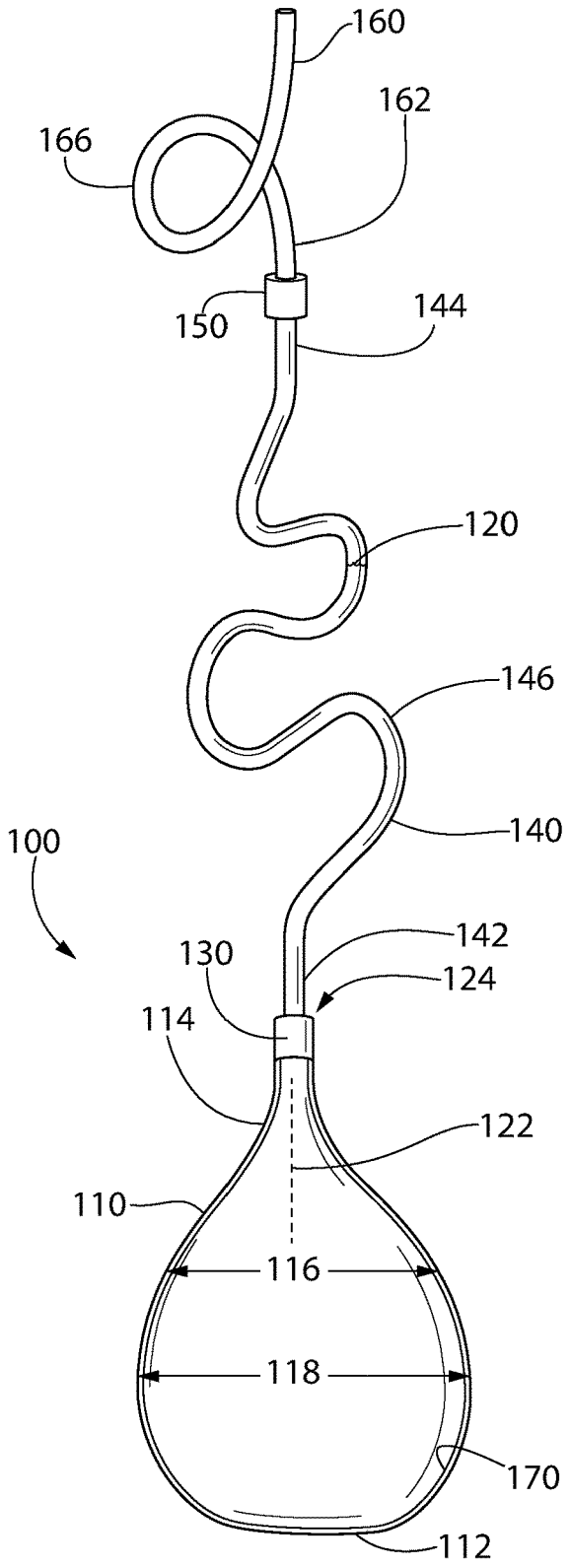
FIG. 1 depicts a front view of a dispenser having a tubular member coupled thereto, according to an embodiment.

FIG. 1 depicts a front view of a dispenser 100 having a tubular member 140 coupled thereto, according to an embodiment. The dispenser 100 may include a body 110. The body 110 may be made of a polymer or elastomer. For example, the body 110 may be made of a blow-molded polyethylene terephthalate ("PET"). The body 110 may define an internal volume. A composition 120 may be stored in the internal volume. The composition 120 may be or include a dentifrice composition (e.g., toothpaste, tooth powder, tooth soap, mouthwash). In other embodiments, the composition 120 may be or include personal care or home care compositions such as lotions, soap, shampoo, conditioner, dish detergent, laundry detergent, fabric softener, surface cleaners, etc.

In one exemplary embodiment, the body 110 may be shaped as shown in FIG. 1. For example, a lower axial end 112 of the body 110 may include a flat lower surface on which the body 110 may rest. A width 116 of the body 110 may increase proceeding upward from the lower axial end 112 to a portion of maximum width 118. The width 116 may then decrease proceeding from the portion of maximum width 118 to an upper axial end 114 of the body 110. Thus, the body 110 may be at least partially substantially spherical, at least partially substantially frustoconical, substantially spheroid, or any other shape. When a cross-section is taken through the body 110 in a plane that is perpendicular to a central longitudinal axis 122 through the body 110, the cross-sectional shape of the body 110 may be substantially circular, ovular, rectangular, or the like at any height along the central longitudinal axis 122.

An opening 124 may be formed through the body 110 proximate to the upper axial end 114, and the opening 124 may provide a path of fluid communication between the internal volume and an exterior of the body 110. A first tubular member 140 may be configured to be coupled to the body 110 proximate to the opening 124. The first tubular member 140 may be coupled to the body 110 via an interference fit, a threaded engagement, a snap-fit, an adhesive, or the like. For example, an outer surface of a first end 142 of the first tubular member 140 may be sized to fit within an inner surface of the body 110 that defines the opening 124 such that an interference fit is formed between the outer surface of the first tubular member 140 and the inner surface of the body 110. In another example, an outer surface of the first end 142 of the first tubular member 140 may have threads thereon that are configured to engage threads on the inner surface of the body 110 that defines the opening 124. When the first tubular member 140 is coupled to the body 110, less than or equal to about 1 cm of the first tubular member 140 may be positioned within the body 110 (e.g., in contrast to a straw in a drink box). In addition, a length of the first tubular member 140 may be greater than or equal to about 100%, about 150%, or about 200% of a height of the body 110.

The first tubular member 140 may include one or more bends, twists, loops, or the like, or it may be straight. As shown, the first tubular member 140 includes four bends 146. The bends 146 may each include a radius of curvature, and the radii of curvature may be the same or different. As shown, a central axis through the first tubular member 140 may be in a single plane. However, as will be appreciated, in other embodiments, e.g., when the first tubular member 140 includes loops or spirals, the central axis may not remain in a single plane. The first tubular member 140 may be substantially rigid and maintain its shape. In another embodiment, the first tubular member 140 may be flexible or malleable and configured to have its shape changed from a first shape (e.g., with four bends 146) to a second shape (e.g., straight) and hold the second shape until the user changes the shape to a third shape or back to the first shape.

In at least one embodiment, a first connector 130 may be coupled to the body 110 proximate to the opening 124. The first connector 130 may serve as a lid that seals the opening 124. Thus, the first connector 130 may prevent the composition 120 from flowing out through the opening 124 and/or from drying out within the internal volume. For example, the first connector 130 may be or include a flip-top cap, a removable plug or valve, or the like. However, as described in greater detail below, when the first tubular member 140 is coupled to the first connector 130, the first connector 130 may be "open" such that a path of fluid communication may exist from the internal volume of the body 110, through the first connector 130, and into the first tubular member 140.

The first tubular member 140 may be configured to be coupled to the first connector 130. The first connector 130 may be coupled to the body 110 via an interference fit, a threaded engagement, a snap-fit, an adhesive, or the like. For example, an outer surface of the body 110 proximate to the opening 124 may be sized to fit within an inner surface of the first connector 130 such that an interference fit is formed between the outer surface of the body 110 and the inner surface of the first connector 130. In another example, the outer surface of the body 110 proximate to the opening 124 may have threads thereon that are configured to engage threads on the inner surface of the first connector 130. The first connector 130 may be substantially straight, or the first connector 130 may be bent or curved. For example, the first connector 130 may be bent at an angle from about 45° to about 90°, about 90° to about 135°, or about 135° to about 179° (with 180° being straight). When the first tubular member 140 is coupled to the first connector 130, less than or equal to about 1 cm of the first tubular member 140 may be positioned within the body 110 and/or the first connector 130 (e.g., in contrast to a straw in a drink box).

When the first connector 130 is present, the first tubular member 140 may be coupled to the first connector 130 via an interference fit, a threaded engagement, a snap-fit, an adhesive, or the like. For example, an outer surface of the first end 142 of the first tubular member 140 may be sized to fit within an inner surface of the first connector 130 such that an interference fit is formed between the outer surface of the first tubular member 140 and the inner surface of the first connector 130. In another example, an outer surface of the first end 142 of the first tubular member 140 may have threads thereon that are configured to engage threads on the inner surface of the first connector 130.

In at least one embodiment, a second connector 150 may be coupled to a second end 144 of the first tubular member 140. The second connector 150 may be coupled to the first tubular member 140 via an interference fit, a threaded engagement, a snap-fit, an adhesive, or the like. For example, an outer surface of the second end 144 of the first tubular member 140 may be sized to fit within an inner surface of the second connector 150 such that an interference fit is formed between the outer surface of the first tubular member 140 and the inner surface of the second connector 150. In another example, the outer surface of the second end 144 of the first tubular member 140 may have threads thereon that are configured to engage threads on the inner surface of the second connector 150. The second connector 150 may be substantially straight, or the second connector 150 may be bent or curved. For example, the second connector 150 may be bent at an angle from about 45° to about 90°, about 90° to about 135°, or about 135° to about 179° (with 180° being straight).

A second tubular member 160 may be coupled to the second connector 150 via an interference fit, a threaded engagement, a snap-fit, an adhesive, or the like. For example, an outer surface of a first end 162 of the second tubular member 160 may be sized to fit within an inner surface of the second connector 150 such that an interference fit is formed between the outer surface of the second tubular member 160 and the inner surface of the second connector 150. In another example, an outer surface of the first end 162 of the second tubular member 160 may have threads thereon that are configured to engage threads on the inner surface of the second connector 150.

The second tubular member 160 may also include one or more bends, twists, loops, or the like, or it may be straight. The second tubular member 160 may have a different shape than the first tubular member 140. As shown, the second tubular member 160 includes a loop 166. As shown, a central axis through the second tubular member 166 may not be in a single plane. The second tubular member 160 may be substantially rigid and maintain its shape. In another embodiment, the second tubular member 160 may be flexible or malleable and configured to have its shape changed from a first shape (e.g., with a loop 166) to a second shape (e.g., straight) and hold the second shape until the user changes the shape to a third shape or back to the first shape.

Figure 2:
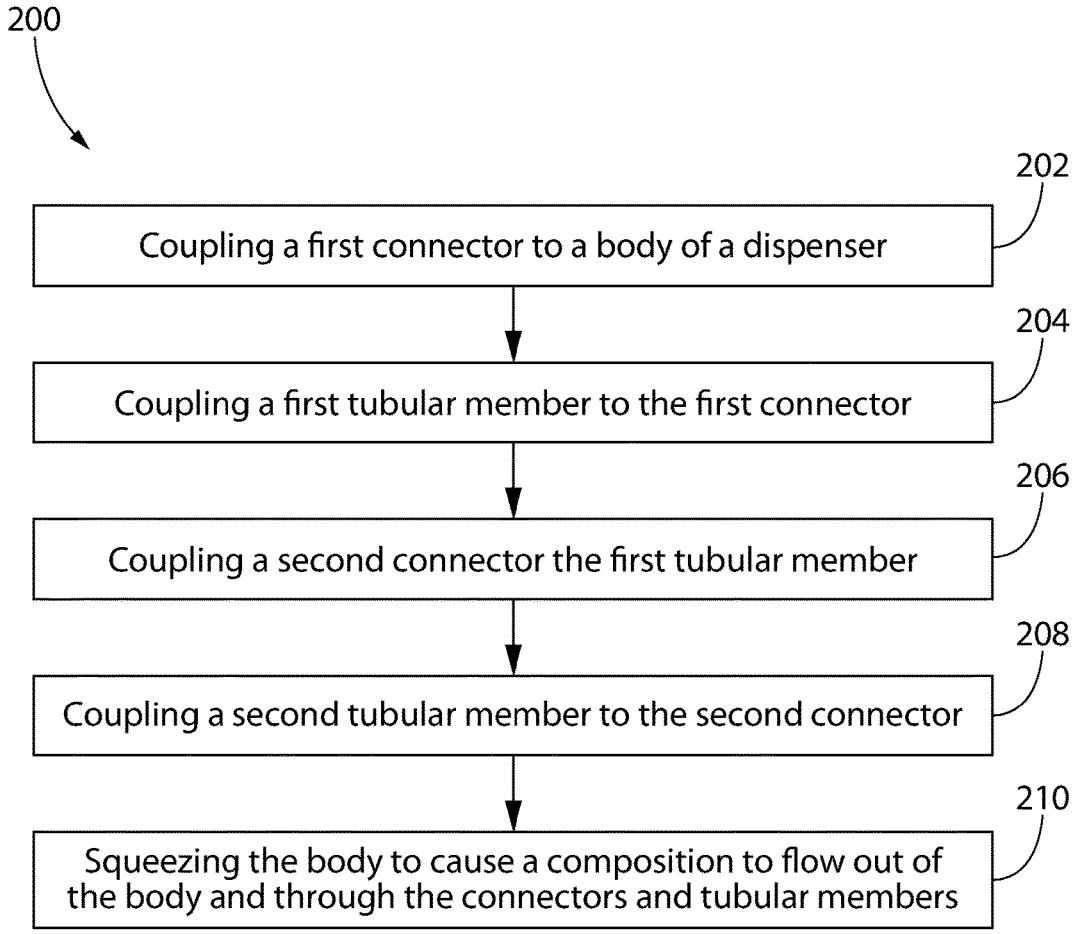
FIG. 2 depicts a flowchart of a method for dispensing a composition from the dispenser of FIG. 1, according to an embodiment.

FIG. 2 depicts a flowchart of a method 200 for dispensing a composition 120 from the dispenser 100, according to an embodiment. The method 200 may include coupling a first connector 130 to a body 110 of the dispenser 100, as at 202. In another embodiment, the first connector 130 may be integral with the body 110, or the first connector 130 may be omitted. The method 200 may also include coupling a first tubular member 140 to the first connector 130 (or to the body 110 when the first connector 130 is omitted), as at 204. The method 200 may also optionally include coupling a second connector 150 to the first tubular member 140, as at 206, and coupling a second tubular member 160 to the second connector 150, as at 208.

The method 200 may also include squeezing the body 110 to cause the composition 120 to flow out of the body 110 through the opening 124, and into/through the first tubular member 140, as at 210. If present, the composition 120 may also flow into/through the first connector 130, the second connector 150, and/or the second tubular member 160. In at least one embodiment, the body 110, the first connector 130, the first tubular member 140, the second connector 150, the second tubular member 160, or a combination thereof may be at least partially transparent or translucent so that the user may see the composition 120 as it flows therethrough. The distance that the composition 120 may flow through the first connector 130 (if present), the first tubular member 140, the second connector 150 (if present), the second tubular member 160 (if present), or a combination thereof before exiting the dispenser 100 may be from about 5 cm to about 50 cm, about 10 cm to about 40 cm, or about 15 cm to about 30 cm.

An inner surface of the body 110, the first connector 130, the first tubular member 140, the second connector 150, the second tubular member 160, or a combination thereof may include a coating 170 disposed thereon. A coefficient of friction between the composition 120 and the coating 170 may be less than a coefficient of friction between the composition 120 and the inner surface of the body 110, the inner surface of the connectors 130, 150, and/or the inner surface of the tubular members 140, 160. Thus, the coating 170 may allow the composition 120 to slide or slosh or otherwise move around within the body 110 and/or move through the connectors 130, 150 and the tubular members 140, 160 (e.g., when the body 110 is squeezed). In at least one embodiment, the coating 170 may be or include a liquid-impregnated surface, as described in U.S. Pat. No. 8,940,361. For example, the coating 170 may include a matrix of solid features spaced sufficiently close to stably contain a liquid therebetween or therewithin. In at least one embodiment, the coating 170 may be or include LiquiGlide® manufactured by LiquiGlide Inc. of Cambridge, Mass.

As the composition 120 flows through the tortuous path provided by the connectors 130, 150 and/or the tubular members 140, 160, the composition 120 may be mixed, which may help the composition 120 be substantially uniform prior to being received by the user, rather than potentially separating into a higher density portion and a lower density portion. Furthermore, watching the composition 120 flow through the tortuous path may amuse, entertain, or appeal to young children, which may encourage them to use the composition 120 (e.g., to brush their teeth).

Figure 3:
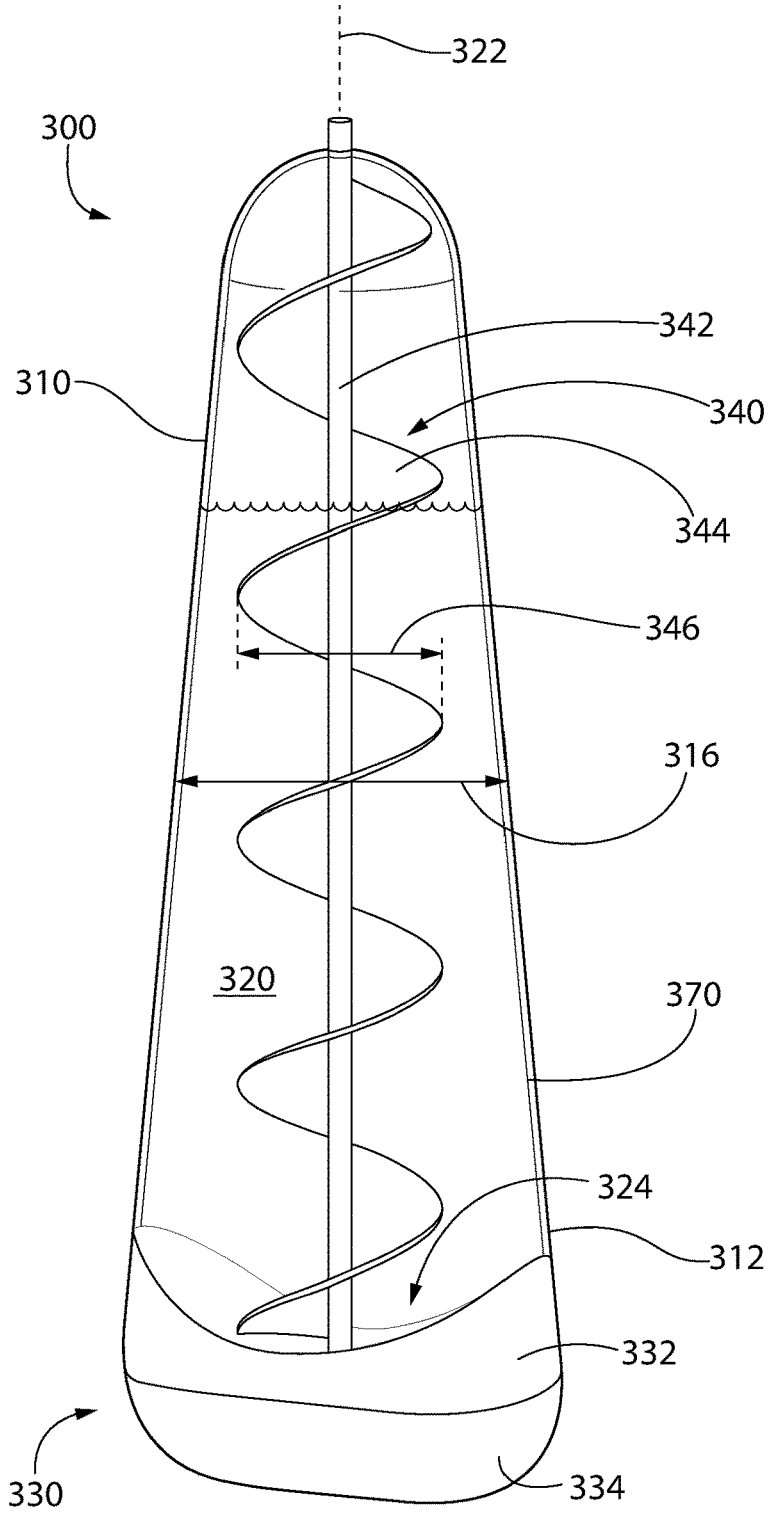
FIG. 3 depicts a perspective view of another dispenser having an internal auger, according to an embodiment.

FIG. 3 depicts a perspective view of another dispenser 300 having an internal auger 340, according to an embodiment. The dispenser 300 may include a body 310. The body 310 may be made of a polymer or elastomer. For example, the body 310 may be made of a blow-molded polyethylene terephthalate ("PET"). The body 310 may define an internal volume. A composition 320 may be stored in the internal volume. The composition 320 may be or include a dentifrice composition (e.g., toothpaste, tooth powder, tooth soap, mouthwash). In other embodiments, the composition 320 may be or include personal care or home care compositions such as lotions, soap, shampoo, conditioner, dish detergent, laundry detergent, fabric softener, surface cleaners, etc.

In one exemplary embodiment, the body 310 may be shaped as shown in FIG. 3. For example, the body 310 may be substantially frustoconical or conical with a width 316 of the body 310 decreasing proceeding upward from a first (e.g., lower) axial end 312. In another embodiment, the body 310 may be substantially cylindrical with the width 316 of the body 310 remaining substantially constant proceeding upward from the first axial end 312. When a cross-section is taken through the body 310 in a plane that is perpendicular to a central longitudinal axis 322 through the body 310, the cross-sectional shape of the body 310 may be substantially circular, ovular, rectangular, or the like at any height along the central longitudinal axis 322.

An opening 324 may be formed through the body 310 proximate to the first axial end 312, and the opening 324 may provide a path of fluid communication between the internal volume and an exterior of the body 310. A lid 330 may be coupled to the body 310 and aligned with (e.g., covering) the opening 324. The lid 330 may include a base 332 that is coupled to or integral with the body 310 and a cap 334. The cap 334 may be coupled to the base 332 via one or more hinges (not shown) such that the cap 334 may be flipped from a closed position (where the cap 334 prevents fluid communication through the opening 324) to an open position (where fluid communication is permitted through the opening 324). In another embodiment, the cap 334 may screw or snap onto the base 332.

An auger 340 may be positioned within the internal volume of the body 310. The auger 340 may include a shaft 342 having a helical screw blade (called a fighting) 344 extending radially-outward therefrom. The shaft 342 of the auger 340 may be parallel to the central longitudinal axis 322 through the body 310. In one embodiment, the shaft 342 may be aligned with the central longitudinal axis 322. As shown, an outer diameter 346 of the screw blade 344 may remain substantially constant proceeding along the central longitudinal axis 322, but the inner cross-sectional width (e.g., diameter) 316 of the body 310 may vary proceeding along the central longitudinal axis 322. Thus, the outer radial surface of the screw blade 344 may not be in contact with the inner surface of the body 310. Rather, in the embodiment shown, the radial gap between the screw blade 344 and the inner surface of the body 310 may increase proceeding downward along the central longitudinal axis 322.

In another embodiment, the body 310 may be substantially cylindrical. As a result, the outer radial surface of the screw blade 344 may be in contact with the inner surface of the body 310, or a gap between the outer radial surface of the screw blade 344 and the inner surface of the body 310 may remain substantially constant and be less than or equal to about 5 mm, less than or equal to about 2 mm, or less than or equal to about 1 mm proceeding along the central longitudinal axis 322.

In yet another embodiment, the outer diameter of the screw blade 344 and the diameter 316 of the body 310 may both vary together proceeding along the central longitudinal axis 322. As a result, the outer radial surface of the screw blade 344 may be in contact with the inner surface of the body 310, or a gap between the outer radial surface of the screw blade 344 and the inner surface of the body 310 may remain substantially constant and be less than or equal to about 5 mm, less than or equal to about 2 mm, or less than or equal to about 1 mm proceeding along the central longitudinal axis 322.

As shown, a portion of the shaft 342 may extend through the first (e.g., lower) axial end 312 of the body 310 or the second (e.g., upper) axial end 314 of the body 310. A seal (not shown) may be positioned between the body 310 and the shaft 342 to prevent the composition 320 from leaking out through the opening through which the shaft 342 extends. The seal may be, for example, an elastomeric O-ring. In another embodiment, the portion of the shaft 342 may not extend through the first (e.g., lower) axial end 312 of the body 310 or the second (e.g., upper) axial end 314 of the body 310, in which case the seal may be omitted. An opposing end of the shaft 342 may be positioned within a recess formed in the inner surface of the body 310 or the lid 330.

Figure 4:
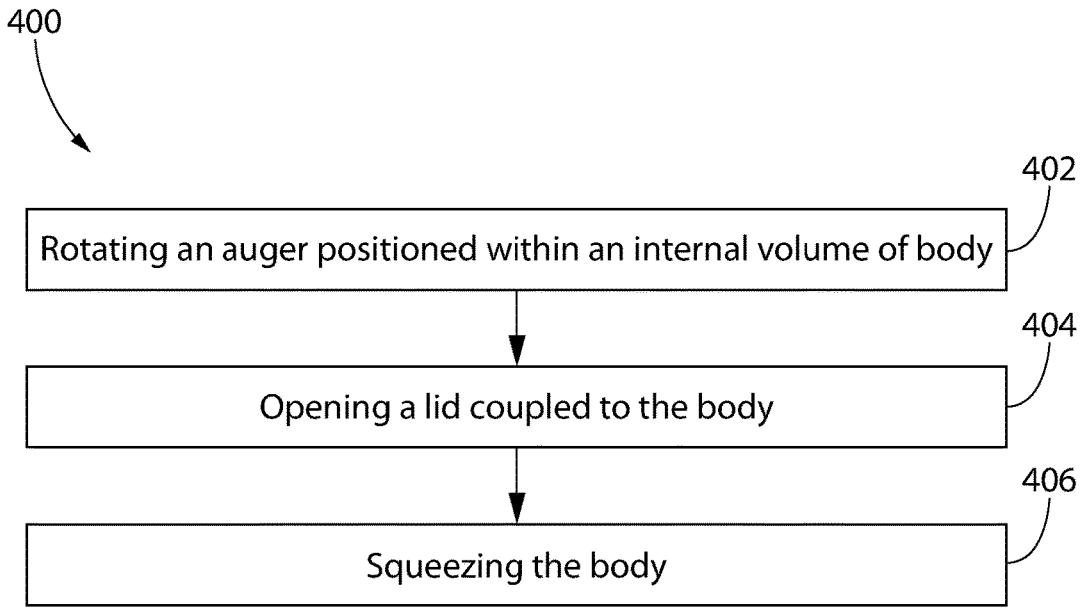
FIG. 4 depicts a flowchart of a method for dispensing a composition from the dispenser of FIG. 3, according to an embodiment.

FIG. 4 depicts a flowchart of a method 400 for dispensing a composition 320 from the dispenser 300 of FIG. 3, according to an embodiment. The method 400 may include rotating an auger 340 positioned within an internal volume of a body 310 of the dispenser 300, as at 402. For example, the user may grab the portion of the shaft 342 that extends out of the body 310 and twist the portion of the shaft 342 clockwise or counterclockwise to cause the auger 340 to rotate. Watching the auger 340 rotate within the body 310 may amuse, entertain, or appeal to young children, which may encourage them to use the composition 320 (e.g., to brush their teeth).

In another embodiment, the auger 340 may be fixed such that it may not be rotated within the body 310. In this embodiment, the auger 340 may be entirely positioned within the body 310 such that there is no portion of the shaft 342 accessible by the user to rotate. When the auger 340 is stationary, at least a portion of the composition 320 may flow downward along the auger 340, in a spiral path, toward the opening 324, as the composition 320 is being dispensed.

The method 400 may also include opening a lid 330 that is coupled to the body 310, as at 404. The lid 400 may be opened before or after the auger 340 is rotated. In one embodiment, the lid 330 may be opened before the auger 340 is rotated. Rotation of the auger 340 in one direction may push the composition 320 toward (and through) the opening 324, and rotation of the auger 340 in the opposing direction may push the composition 320 away from the opening 324. In another embodiment, the lid 330 may be opened after the auger 340 is rotated, and the rotation of the auger 340 may serve to mix the composition 320 within the body 310 prior to dispensing the composition 320. This may help the composition 320 be substantially uniform prior to being received by the user, rather than potentially separating into a higher density portion and a lower density portion. In yet another embodiment, the auger 340 may not be rotated before or after the lid 330 is opened.

The method 400 may also include squeezing the body 310, as at 406. The composition 320 may flow out of the body 310 through the opening 324 when the lid 330 is in the open position due to gravity, rotation of the auger 340, squeezing the body 310, or a combination thereof.

An inner surface of the body 310, an outer surface of the auger 340, or a combination thereof may include a coating 370. A coefficient of friction between the composition 320 and the coating 370 may be less than a coefficient of friction between composition 320 and the inner surface of the body 310 and/or the outer surface of the auger 340. Thus, the coating 370 may allow the composition 320 to slide or slosh or otherwise move around within the body 310 when the auger 340 rotates and/or when the body 310 is squeezed. In at least one embodiment, the coating 370 may be or include LiquiGlide®.

What is claimed is:

1. A dispenser, comprising:

a body extending from a first axial end to a second axial end, the body defining an internal volume and a dispensing opening formed through the body at the first axial end, wherein the opening provides a path of fluid communication between the internal volume and an exterior of the body;

an auger positioned within the internal volume, the auger extending from the first axial end to the second axial end; wherein the auger is attached to the body in a fixed position within the internal volume such that the auger cannot be rotated;

a composition in the internal volume; and a lid coupled to the first axial end of the body and forming a base on which the body rests.

2. The dispenser of claim 1, further comprising a coating on an inner surface of the body, wherein a coefficient of friction between the composition and the coating is less than a coefficient of friction between the composition and the inner surface of the body.

3. The dispenser of claim 2, wherein the coating is also positioned on an outer surface of the auger.

4. The dispenser of claim 1, wherein the body is substantially cylindrical, and wherein an outer diameter of the auger is within 2 mm of an inner diameter of the body.

5. The dispenser of claim 1, wherein an outer diameter of the auger remains substantially constant, and wherein an inner diameter of the body varies.

6. The dispenser of claim 1, wherein an outer diameter of the auger and an inner diameter of the body vary together proceeding along a central longitudinal axis through the body such that the outer diameter of the auger remains within 2 mm of the inner diameter of the body.

* * * * *